United States Patent [19]

Godot

[11] 4,118,898

[45] Oct. 10, 1978

[54] MOUNTING BLOCK FOR MOUNTING A LENS IN A LENS TRIMMING AND BEVELLING MACHINE

[75] Inventor: Jean Marie Godot, Brunoy, France

[73] Assignee: Essilor International, Joinville Le Pont, France

[21] Appl. No.: 796,006

[22] Filed: May 11, 1977

[30] Foreign Application Priority Data

May 18, 1976 [FR] France ..... 76 14905

[51] Int. Cl.[2] ..... B24B 41/06

[52] U.S. Cl. ..... 51/216 LP

[58] Field of Search ..... 51/216 LP, 217 L

[56] References Cited

U.S. PATENT DOCUMENTS

| | | | |
|---|---|---|---|
| 2,264,392 | 12/1941 | McClernon | 51/217 L |
| 2,491,219 | 12/1949 | Seidner | 51/217 L |
| 3,962,833 | 6/1976 | Johnson | 51/216 LP |

FOREIGN PATENT DOCUMENTS

| | | | |
|---|---|---|---|
| 162,308 | 6/1948 | Fed. Rep. of Germany | 51/217 L |
| 2,037,604 | 4/1971 | Fed. Rep. of Germany | 51/217 L |

*Primary Examiner*—Harold D. Whitehead

*Attorney, Agent, or Firm*—Burgess, Ryan and Wayne

[57] ABSTRACT

A mounting block for mounting a lens on a trimming and bevelling machine is made of flexible plastic material and adapted to be fixed onto one lens surface by means of a thin film of adhesive material; said block comprises orienting and driving means which cooperate with complementary means mounted on the spindle of the machine. The mounting block is formed with a flexible circular web portion having a conical lower surface which constitutes the lens-contacting surface, and which is provided with a recess in its central portion; the web portion is provided with at least one outwardly extending gripping tab adapted to facilitate the removal of the block from the lens.

4 Claims, 5 Drawing Figures

MOUNTING BLOCK FOR MOUNTING A LENS IN A LENS TRIMMING AND BEVELLING MACHINE

The present invention is related to a mounting block for mounting a lens, and more particularly an ophtalmic lens, on a lens trimming and bevelling machine.

In the copying machines for trimming and bevelling ophtalmic lenses the lens to be machined, i.e. ground, is fixed onto a rotary spindle mounted on a movable head of the machine. On this spindle is also fixed a model or copying templet having the configuration which it is desired to confer to the lens. This templet cooperates with a stationary stop member and thus limits the distance between the axis of rotation of the spindle and the grinding wheel.

In this manner the lens is machined progressively until it has the same shape as that of the tamplet.

With a view to conveniently positioning the lens with respect to the copying templet it is current practice to use a centering device.

A mounting means adapted to allow the lens to be fixed to the rotary spindle of the machine is then applied onto said lens.

This mounting means may be constituted, in a well known manner, by a suction-grip, a block of metal having a low fusion temperature which is moulded onto one of the surfaces of the lens, or a block of plastic material glued onto one of the surfaces of the lens.

The object of the present invention is to provide an improvement to this latter type of mounting means, and more particularly to provide a novel mounting block made of plastic material which allows the drawbacks of the known mounting blocs to be overcome.

The known mounting blocs made of plastic material, such as disclosed, e.g., in French Pat. No. 2,252,171 require the use of pincers or the like when it is desired to remove said mounting blocks from the surfaces onto which they had been applied.

The mounting block according to the instant invention eliminates the necessity of using a particular tool, such as pincers or the like, to this end it comprises gripping means adapted to facilitate the separation of the mounting block from the related lens surface after the peripheral rim thereof has been ground.

The mounting block according to the present invention also comprises means for positioning said block in a controlled manner on the surface of a lens; said positioning may be performed e.g. by means of an auxliary device of a centering apparatus, for example the device disclosed in French Pat. No. 1,493,482.

The mounting block according to the invention, which is made of a flexible plastic material, can be fixed onto one of the surfaces of a lens by means of a thin film of adhesive material and comprises orienting and driving means adapted to cooperate with complementary means mounted on the spindle of the trimming machine, one essential feature of said mounting block residing in the fact that it further comprises a flexible circular web portion the lower surface of which has a conical shape and constitutes the lens engaging surface of said block, while a recess is provided in the central portion of said conical surface, said flexible web portion being provided with at least one gripping tab.

The invention will be described in a more detailed manner herein after with reference to the appended drawing which shows various embodiments of the invention, by way of illustration, but not of limitation.

Figure 1:
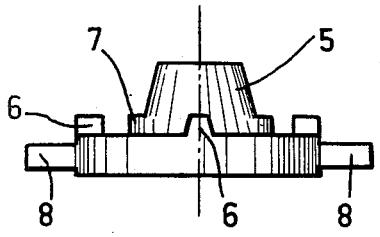
FIG. 1 is a side view of a mounting block according to the invention.

The mounting block according to the invention comprises a flexible circular web portion 1 the lower surface 1A of which has a conical shape and constitutes the lens-engaging surface of said block.

The cone defined by said lower or lens-engaging surface has a large cone angle, e.g. an angle of about 170°.

A recess 2 is provided in the central portion of conical surface 1A.

The peripheral portion of web portion 1 is provided at its upper side with a first annular portion 3, while the central portion of said web portion is provided at its upper side with a second annular portion 4 integral with an upwardly extending centering cone 5.

Three bosses are provided on the upper side of each annular portion. These bosses, which are designated by reference numeral 6 as far as annular portion 3 is concerned, and with reference numeral 7 as far as annular portion 4 is concerned, have a trapezoidal cross-section shape and are arranged on two perpendicular axes X–X′ and Y–Y′, respectively.

Circular web portion 1 is also provided with at least one outwardly extending gripping tab 8.

Each mounting block may comprise, for example, two gripping tabs 8 arranged on axis X–X′.

The lower surface 8A of gripping tabs 8 is offset with respect to the lower surface 1A of web portion 1 so as to define an interval between the lens surface and said gripping tabs when the mounting block is fixed onto the lens, with a view to facilitating the removal of said block from the lens.

Recess 2 situated in the central portion of conical surface 1A may extend upwardly through centering cone 5 so as to define within the latter a hole 9 which may have, for example, a conical shape.

This hole 9 may allow the position of the mounting block on the lens to be checked when said lens is provided with centering marks on its surface onto which the block is to be fixed.

Figure 5:
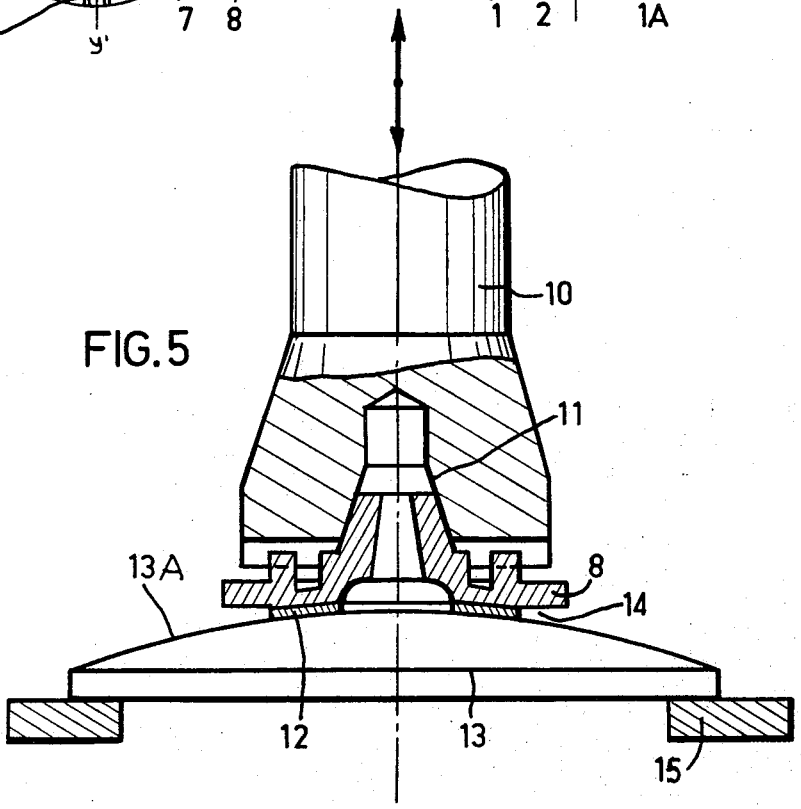
FIG. 5 is a side view, partially in section, showing a mounting blocks according to the invention fixed onto a convex lens surface.

The mounting block according to the invention may be fixed onto the convex surface of a lens by means of an auxiliary device such as the one partially shown in FIG. 5, such device not being part of the present invention, consequently it has not been described in detail herein.

The mounting block according to the invention is mounted onto the end of a vertically movable supporting arm 10.

The mounting block is centered and maintained in position by cone 5 which is engaged into, and then wedged in, a corresponding conical recess provided in arm 10.

The orientation of the mounting block is achieved by bosses 6 and 7 which engage corresponding grooves provided in arm 10.

The mounting block comprises, in a manner known per se, a thin film 12 of adhesive material which is applied onto surface 1A by any convenient known means.

Lens 13 is placed onto support 15 of the centering apparatus and positioned with reference to the centering marks (not shown in the drawing).

Supporting arm 10 is moved downwardly, and the mounting block is fixed by means of the thin adhesive film 12 onto the convex surface of lens 13.

When the mounting block is being applied onto lens 13, the initially conical surface 1A undergoes a progressive deformation and adapts itself to the shape of said convex lens surface.

Said convex lens surface may be a spherical, cylindrical or toric surface, or it may have a progressively varying shape.

Due to the conical shape of surface 1A, the deformation of the latter can be reduced to a minimum, contrary to the planar lens engaging surfaces which undergo maximum deformation.

The cone angle defined by said lens engaging surface is selected in such a manner that the conical surface is tangent to the basic spherical surfaces having a curvature radius comprised between 60 and 120 mm.

As clearly shown in FIG. 5, surface 8*a* of gripping tabs 8, whichs is offset with respect to the lower surface 1A of web member 1, defines an interval 14 between the convex lens surface 13A of lens 13 and said gripping tabs, this interval being adapted to facilitate the removal of the mounting block from the lens without the use of a special tool.

Figure 4:
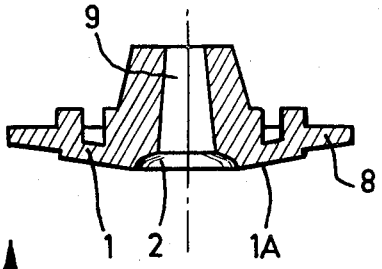
FIG. 4 is a cross-sectional side view of a mounting block according to the invention which is adapted to be fixed onto a concave lens surface.

FIG. 4 shows a mounting block according to the invention which is adapted to be fixed onto a concave lens surface.

Figure 3:
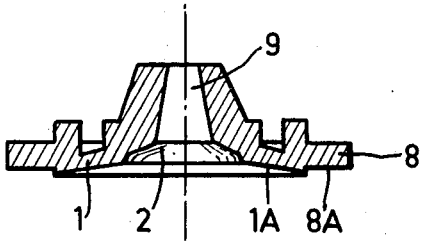
FIG. 3 is a cross-sectional side view of a mounting block according to the invention which is adapted to be fixed onto a convex lens surface.
Figure 2:
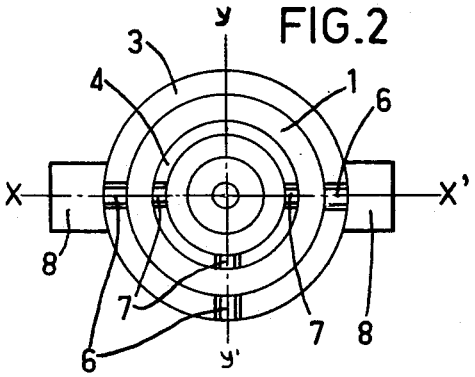
FIG. 2 shows a mounting block according to the invention, viewed from above.

The conical lens engaging surface 1A of web member 1 has the same conicity as that of the lens engaging surface of the mounting block shown in FIG. 3, however in the present case, the conicity is inversed in such a manner that the lens engaging surface 1A of the embodiment shown in FIG. 4 is adaptable to a concave lens surface, while undergoing a minimum deformation.

It will be well understood that the invention is not limited to the embodiments shown and described herein above. Many modifications may be made by those skilled in the art without departing from the spirit and scope of the invention as defined in the appended claims.

What is claimed is:

1. A mounting block for mounting an optical lens on one end of the spindle of a trimming and bevelling machine, said block being made of a flexible plastic material and adaped to be fixed only to one of the major surfaces of said lens by means of a thin film of adhesive material, said block comprising orienting and driving means adapted to cooperate with complementary means provided on said spindle, said block further comprising a flexible circular web portion defining a lens holding surface of generally conical shape, coated with a layer of said adhesive material and adapted to engage a central portion of one major surface of said lens, a central recess being provided adjacent the apex of said generally conical lens-holding surface, the periphery of said web portion having at least one outwardly extending gripping tab with a surface facing said lens surface and offset with respect to said lens holding surface of said web portion by a shoulder part of said bock, so as to define a space between said lens surface and said gripping tab when said lens is affixed to said mounting block.

2. A mounting block for mounting a lens, especially an ophthalmic lens, on one end of the spindle of a trimming and bevelling machine, said block being made of a flexible plastic material and adapted to be fixed only to one of the major surfaces of said lens by means of a thin film of adhesive material, said block comprising orienting and driving means adapted to cooperate with complementary means provided on said spindle, said block further comprising a flexible web portion defining a lens-holding surface of generally conical shape, coated with a layer of said adhesive material and adapted to engage a central portion of one surface of said lens, a recess being provided in the central portion of said conical lens-holding surface, said web portion being provided with at least one outwardly extending gripping tab having a surface facing said lens surface and offset with respect to said lens-holding surface of said web portion, so as to define a substantial space between said lens surface and said gripping tab when said lens is fixed on said mounting block, a centering cone extending axially from said side of said web portion which is located opposite said lens-holding surface, saidcone being provided with an axial through-hole and being adapted to allow said mounting blockto be positioned in a controlled manner on said lens.

3. The mounting block of claim 2, wherein said lens-holding surface is concave.

4. The mounting block of claim 2, wherein said lens-holding surface is convex.

* * * * *

UNITED STATES PATENT OFFICE

CERTIFICATE OF CORRECTION

Patent No. 4,118,898 Dated October 10, 1978

Inventor(s) Jean Marie Godot

It is certified that error appears in the above-identified patent and that said Letters Patent are hereby corrected as shown below:

Column 1, lines 6 and 9, "ophtalmic", each occurrence, should read -- ophthalmic --.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*